US006802080B2

(12) United States Patent
Hawley

(10) Patent No.: US 6,802,080 B2
(45) Date of Patent: Oct. 12, 2004

(54) PROTECTIVE SUPPORT USED WHEN KNEELING

(76) Inventor: Alan Everett Hawley, P.O. Box 67, Yorkshire, NY (US) 14173

( * ) Notice: Subject to any disclaimer, the term of this patent is extended or adjusted under 35 U.S.C. 154(b) by 0 days.

(21) Appl. No.: 10/227,331

(22) Filed: Aug. 24, 2002

(65) Prior Publication Data

US 2004/0049832 A1 Mar. 18, 2004

(51) Int. Cl.[7] ..... A41D 13/00
(52) U.S. Cl. ..... 2/22
(58) Field of Search ..... 2/22, 23–24, 62, 2/455, 16, 267, 413, 911, DIG. 3; 128/882; 602/13, 23, 26, 62

(56) References Cited

U.S. PATENT DOCUMENTS 2,733,443 A 2/1956 Holder
5,073,986 A * 12/1991 Farrago ..... 2/22
6,178,555 B1 1/2001 Williams
6,256,787 B1 * 7/2001 Tyler ..... 2/22
6,317,888 B1 11/2001 McFarlane
6,405,383 B2 6/2002 Heller et al.
6,415,441 B1 * 7/2002 Nelson ..... 2/22
6,427,239 B1 8/2002 Worden
6,438,754 B1 8/2002 Canney

* cited by examiner

*Primary Examiner*—Tejash Patel
(74) *Attorney, Agent, or Firm*—Hayes Soloway P.C.

(57) ABSTRACT

A knee and foot protective support device is provided for removing pressure from the knees, legs and feet of a person who is kneeling. The device includes a rigid frame having a back portion, a front portion, a side panel and a foot panel. The front portion of the frame has a top section and a bottom section. Padding is attached to the back portion and provides support for the knee, front portion of the leg and foot. A plurality of securing members are attached to the frame for removably securing the device to the leg.

14 Claims, 1 Drawing Sheet

PROTECTIVE SUPPORT USED WHEN KNEELING

FEDERALLY SPONSORED

Not Applicable

SEQUENCE LISTING

Not Applicable

1. Field of Invention

Figure 1:
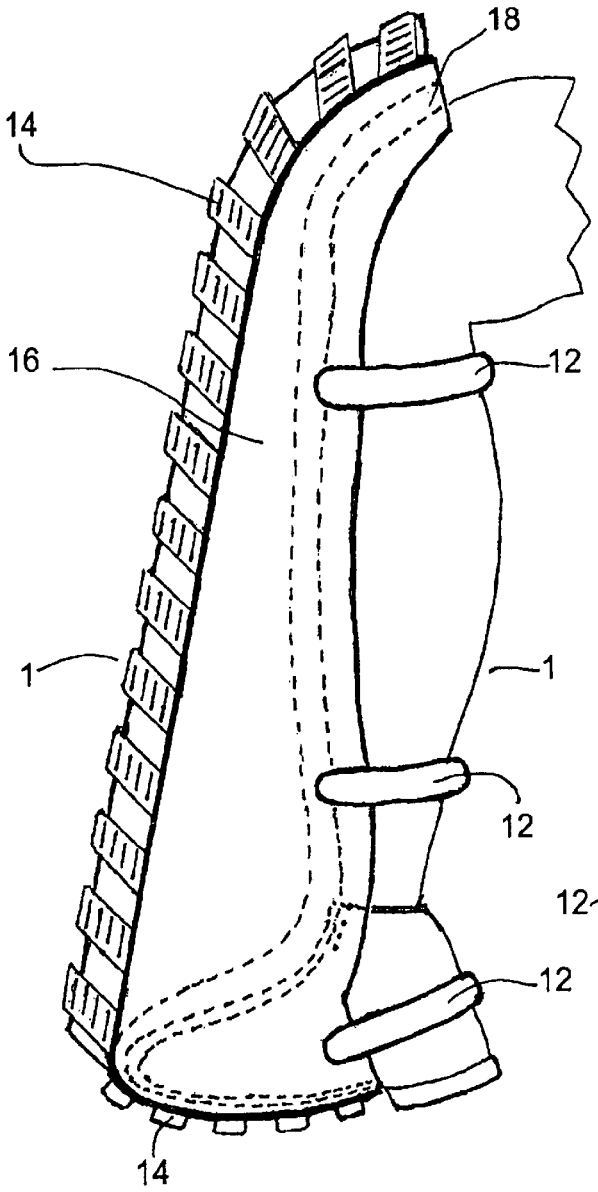
Figure 2:
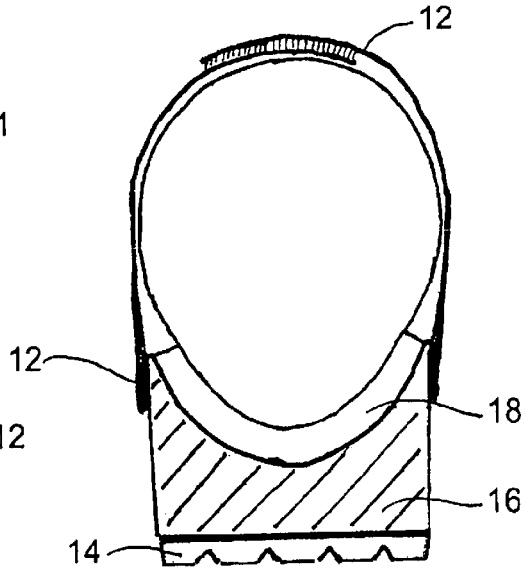

My invention relates to a ridged padded frame to support and protect the knees, legs, and feet while kneeling.

2. Description of Prior Art

Manufacturers have produced many types of knee protection for kneeling. They do not stay in place well. They do not maintain their shape very long. They do not provide much comfort. They do not protect or support the legs and feet.

SUMMARY

My invention consists of a ridged frame with a flexible raised and grooved cross ribbed front and sole, with the opposite side formed to the contour of the knee, leg, and shoe and lined with continuous foam padding. My invention being strapped to the leg and foot will stay in place. The ridged frame will maintain its shape and provide continuous support. The object of the invention is to enable a person to work comfortably while kneeling.

DRAWING

In my drawing a frame consisting of ridged material (16) has a vertical flat front and sole. Attached to it is a material comprising of a continuous backing with soft, flexible, raised and grooved cross ribs. (14) The leg side formed to the contour of the leg has continuous foam padding (18) from the toe to above the knee. The frame has three over lapping self holding straps (12) attached to secure the frame to the leg and shoe.

DETAILED DESCRIPTION OF INVENTION

My invention consists of a light weight ridged frame formed in a mold with a straight, flat vertical front and sole. The opposite side formed to the contour of the knee, leg, and sole of the shoe. The front side and sole has material with flexible raised cross ribs containing grooves And attached with heat or adhesives. The leg side has continuous foam padding from the toe to above the knee attached with adhesive. The frame has self holding straps attached and extending around the back of the leg and shoe and over lapping each other. One strap is just under the knee, one is just above the ankle with the lower one around the back of the shoe. These straps allow very easy on and off.

I claim:

1. A protective support for the knee, leg and foot of a user, comprising:

a rigid frame extending from a position above the knee to a position below the foot of the user, said frame having a front portion and a back portion, and said front portion comprising a top section and a bottom section;

wherein said rigid frame has a recess formed therein, said recess adapted to receive the foot of the user.

2. A protective support as claimed in claim 1, further comprising at least one strap for securing the rigid frame to the user.

3. A protective support as claimed in claim 2, wherein said strap is positioned on said frame near the foot of the user.

4. A protective support as claimed in claim 2, wherein said strap is positioned on said frame between the foot and knee of the user.

5. A protective support as claimed in claim 1, further comprising a padded portion disposed between said user and said rigid frame.

6. A protective support as claimed in claim 1, wherein an outermost dimension of said front portion lies on a plane substantially parallel to a flat surface, when the user is kneeling on said flat surface.

7. A protective support as claimed in claim 1, further comprising at least one ridge disposed on said front portion.

8. A protective support as claimed in claim 7, wherein said ridge has at least one groove formed therein.

9. A protective support as claimed in claim 7, wherein said ridge is flexible.

10. A protective support as claimed in claim 7, wherein said ridge is soft.

11. A protective support as claimed in claim 7, further comprising a hook-and-loop fastener for securing said strap.

12. A protective support as claimed in claim 7, further comprising a buckle for securing said strap.

13. A protective support as claimed in claim 7, wherein said at least one ridge is disposed on said bottom portion.

14. A protective support as claimed in claim 7, wherein said at least one ridge is disposed on said top portion.

* * * * *